US009468798B2

(12) United States Patent
Dalebout

(10) Patent No.: US 9,468,798 B2
(45) Date of Patent: Oct. 18, 2016

(54) DECOUPLED ARM SUPPORTS IN AN ELLIPTICAL MACHINE

(71) Applicant: ICON Health & Fitness, Inc., Logan, UT (US)

(72) Inventor: William T. Dalebout, North Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 8 days.

(21) Appl. No.: 14/575,771

(22) Filed: Dec. 18, 2014

(65) Prior Publication Data

US 2015/0182788 A1 Jul. 2, 2015

Related U.S. Application Data

(60) Provisional application No. 61/920,832, filed on Dec. 26, 2013.

(51) Int. Cl.

| | |
|---|---|
| ***A63B 22/04*** | (2006.01) |
| ***A63B 22/06*** | (2006.01) |
| ***A63B 71/06*** | (2006.01) |
| ***A63B 21/008*** | (2006.01) |
| ***A63B 21/012*** | (2006.01) |
| ***A63B 21/02*** | (2006.01) |
| ***A63B 21/05*** | (2006.01) |
| ***A63B 21/22*** | (2006.01) |
| ***A63B 22/00*** | (2006.01) |
| ***A63B 24/00*** | (2006.01) |

(52) U.S. Cl.

CPC ..... *A63B 22/0664* (2013.01); *A63B 21/0083* (2013.01); *A63B 21/012* (2013.01); *A63B 21/023* (2013.01); *A63B 21/05* (2013.01); *A63B 21/225* (2013.01); *A63B 22/001* (2013.01); *A63B 22/0012* (2013.01); *A63B 24/0062* (2013.01); *A63B 24/0087* (2013.01); *A63B 71/0622* (2013.01); *A63B 2022/067* (2013.01); *A63B 2022/0682* (2013.01); *A63B 2071/0625* (2013.01)

(58) Field of Classification Search

USPC ..... 482/1–148

See application file for complete search history.

(56) References Cited

U.S. PATENT DOCUMENTS

| | | | | |
|---|---|---|---|---|
| 5,290,214 | A * | 3/1994 | Chen | A63B 21/0628 482/100 |
| 6,422,976 | B1 * | 7/2002 | Eschenbach | A63B 22/001 482/51 |
| 6,485,395 | B1 | 11/2002 | Stearns et al. | |
| 6,569,061 | B2 | 5/2003 | Stearns et al. | |
| 7,270,625 | B2 * | 9/2007 | Miller | A63B 22/001 482/52 |
| 7,479,093 | B1 * | 1/2009 | Immordino | A63B 22/0002 482/52 |
| 7,871,356 | B2 | 1/2011 | Smith | |
| 8,033,961 | B2 * | 10/2011 | Kuo | A63B 21/154 482/51 |

(Continued)

*Primary Examiner* — Stephen Crow

(74) *Attorney, Agent, or Firm* — Holland & Hart LLP

(57) ABSTRACT

An exercise machine includes a first foot pedal and a second foot pedal movably attached to a frame and arranged to travel along reciprocating paths. A pedal resistance mechanism is integrated into the exercise machine and arranged to resist movement of the first foot pedal and the second foot pedal along the reciprocating paths. A first arm support and a second arm support are movably attached to the frame where the first arm support and the second arm support are mechanically independent of the first foot pedal and the second foot pedal. Further, a dampening assembly is arranged to resist movement of the first arm support and the second arm support.

15 Claims, 7 Drawing Sheets

(56) References Cited

U.S. PATENT DOCUMENTS 8,801,580 B1 * 8/2014 Maresh ..... A63B 22/001 482/52

2006/0199701 A1 * 9/2006 May ..... A63B 22/0012 482/52

2006/0293153 A1 * 12/2006 Porth ..... A63B 21/4047 482/52

* cited by examiner

DECOUPLED ARM SUPPORTS IN AN ELLIPTICAL MACHINE

RELATED APPLICATIONS

This application claims priority to provisional Patent Application No. 61/920,832 titled "Decoupled Arm Supports in an Elliptical Machine" filed Dec. 26, 2013. This application is herein incorporated by reference for all that it discloses.

BACKGROUND

Aerobic exercise is a popular form of exercise that improves one's cardiovascular health by reducing blood pressure and providing other benefits to the human body. Aerobic exercise generally involves low intensity physical exertion over a long duration of time. Typically, the human body can adequately supply enough oxygen to meet the body's demands at the intensity levels involved with aerobic exercise. Popular forms of aerobic exercise include running, jogging, swimming, and cycling among other types of aerobic exercise. In contrast, anaerobic exercise typically involves high intensity exercises over a short duration of time. Popular forms of aerobic exercise include strength training and short distance running Many choose to perform aerobic exercises indoors, such as in a gym or their home. Often, a user will use an aerobic exercise machine to have an aerobic workout indoors. One such type of aerobic exercise machine is an elliptical exercise machine, which often includes foot supports that move in reciprocating directions when moved by the feet of a user. Often, the foot supports will be mechanically linked to arm levers that can be held by the user during the workout. The arm levers and foot supports move together and collectively provide resistance against the user's motion during the user's workout. Other popular exercise machines that allow a user to perform aerobic exercises indoors include treadmills, rowing machines, stepper machines, and stationary bikes to name a few.

One type of elliptical exercise machine is disclosed in U.S. Pat. No. 6,569,061 issued to Kenneth W. Sterns, et al. This reference describes an exercise apparatus with a frame, left and right leg members pivotally mounted on the frame, and left and right handlebars pivotally mounted on the frame. Various arrangements are provided to facilitate switching, during leg exercise motion, between a first mode of operation involving commensurate arm exercise motion and leg exercise motion, and a second mode of operation involving leg exercise motion without commensurate arm exercise motion. Other types of elliptical exercise machines are described in U.S. Pat. No. 7,871,356 issued to Charles Smith and U.S. Pat. No. 6,485,395 also issued to Kenneth W. Sterns, et al. Each of these references are herein incorporated by reference for all that they contain.

SUMMARY

In one aspect of the invention, an exercise machine includes a first foot pedal and a second foot pedal movably attached to a frame and arranged to travel along reciprocating paths.

In one aspect of the invention, the exercise machine may further include a pedal resistance mechanism integrated into the exercise machine and arranged to resist the travel along the reciprocating paths of the first foot pedal and the second foot pedal along the reciprocating paths.

In one aspect of the invention, the exercise machine may further include a first arm support and a second arm support movably attached to the frame where the first arm support and the second arm support are mechanically independent of the first foot pedal and the second foot pedal.

In one aspect of the invention, the exercise machine may further include a dampening assembly arranged to resist movement of the first arm support and the second arm support.

In one aspect of the invention, the dampening assembly may comprise a pad positioned to slow a movement of the first arm support and/or the second arm support.

In one aspect of the invention, the dampening assembly may comprise a gas spring with a first end connected to the frame and a second end connected to either of the first support arm or the second support arm.

In one aspect of the invention, the dampening assembly may comprise a first dampening unit proximate the first arm support and a second dampening unit proximate the second arm support.

In one aspect of the invention, the dampening assembly may include an adjustable arm resistance mechanism.

In one aspect of the invention, the adjustable arm resistance mechanism may be arranged to change a resistance level in response to user input from an input mechanism incorporated into a control module of the exercise machine.

In one aspect of the invention, the exercise machine may be an elliptical exercise machine.

In one aspect of the invention, the pedal resistance mechanism may be a magnetic resistance mechanism that comprises at least one flywheel.

In one aspect of the invention, the first foot pedal may be connected to the second foot pedal through a crank assembly.

In one aspect of the invention, the crank assembly may comprises a first shaft connected to the first foot pedal and a first flywheel and a second shaft connected to the second foot pedal and a second flywheel.

In one aspect of the invention, the first foot pedal may be slideably connected to a first track and arranged to move along a first length of the first track and the second foot pedal is slideably connected to a second track and arranged to move along a second length of the second track.

In one aspect of the invention, the exercise machine may further include a first sliding resistance mechanism incorporated into the first track and a second sliding resistance mechanism incorporated into the second track.

In one aspect of the invention, the dampening assembly may restrict a range of movement of the first arm support and the second arm support.

In one aspect of the invention, the exercise machine may further include a first foot pedal and a second foot pedal movably attached to a frame and arranged to travel along reciprocating paths.

In one aspect of the invention, the exercise machine may further include a pedal resistance mechanism integrated into the exercise machine and arranged to resist the travel along the reciprocating paths of the first foot pedal and the second foot pedal along the reciprocating paths.

In one aspect of the invention, the first foot pedal may be connected to the second foot pedal through a crank assembly.

In one aspect of the invention, the crank assembly may comprise a first shaft connected to the first foot pedal and a first flywheel and a second shaft connected to the second foot pedal and a second flywheel.

In one aspect of the invention, the exercise machine may further include a first arm support and a second arm support movably attached to the frame where the first arm support and the second arm support are mechanically independent of the first foot pedal and the second foot pedal.

In one aspect of the invention, the exercise machine may further include a dampening assembly arranged to resist a movement of the first arm support and the second arm support.

In one aspect of the invention, the dampening assembly may comprise a first dampening unit approximate the first arm support and a second dampening unit proximate the second arm support.

In one aspect of the invention, the dampening assembly may comprise a pad positioned to slow a movement of either the first arm support or the second arm support.

In one aspect of the invention, the dampening assembly may comprise a gas spring with a first end connected to the frame and a second end connected to either of the first support arm or the second support arm.

In one aspect of the invention, the dampening assembly may include an adjustable arm resistance mechanism.

In one aspect of the invention, the first foot pedal may be slideably connected to a first track and arranged to move along a first length of the first track and the second foot pedal is slideably connected to a second track and arranged to move along a second length of the second track.

In one aspect of the invention, the exercise machine may further include a first sliding resistance mechanism incorporated into the first track and a second sliding resistance mechanism incorporated into the second track.

In one aspect of the invention, the exercise machine may further include a first foot pedal and a second foot pedal movably attached to a frame and arranged to travel along reciprocating paths.

In one aspect of the invention, the exercise machine may further include a pedal resistance mechanism integrated into the exercise machine and arranged to resist the travel along the reciprocating paths of the first foot pedal and the second foot pedal along the reciprocating paths.

In one aspect of the invention, the first foot pedal may be connected to the second foot pedal through a crank assembly.

In one aspect of the invention, the crank assembly may comprise a first shaft connected to the first foot pedal and a first flywheel and a second shaft connected to the second foot pedal and a second flywheel.

In one aspect of the invention, the first foot pedal may be slideably connected to a first track and arranged to move along a first length of the first track and the second foot pedal is slideably connected to a second track and arranged to move along a second length of the second track.

In one aspect of the invention, the exercise machine includes a first sliding resistance mechanism incorporated into the first track and a second sliding resistance mechanism incorporated into the second track.

In one aspect of the invention, the exercise machine may further include a first arm support and a second arm support movably attached to the frame where the first arm support and the second arm support are mechanically independent of the first foot pedal and the second foot pedal.

In one aspect of the invention, the exercise machine may further include a dampening assembly arranged to resist movement of the first arm support and the second arm support.

In one aspect of the invention, the exercise machine may further include that the dampening assembly comprises a first dampening unit approximate the first arm support and a second dampening unit proximate the second arm support.

Any of the aspects of the invention detailed above may be combined with any other aspect of the invention detailed herein.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

Figure 1:
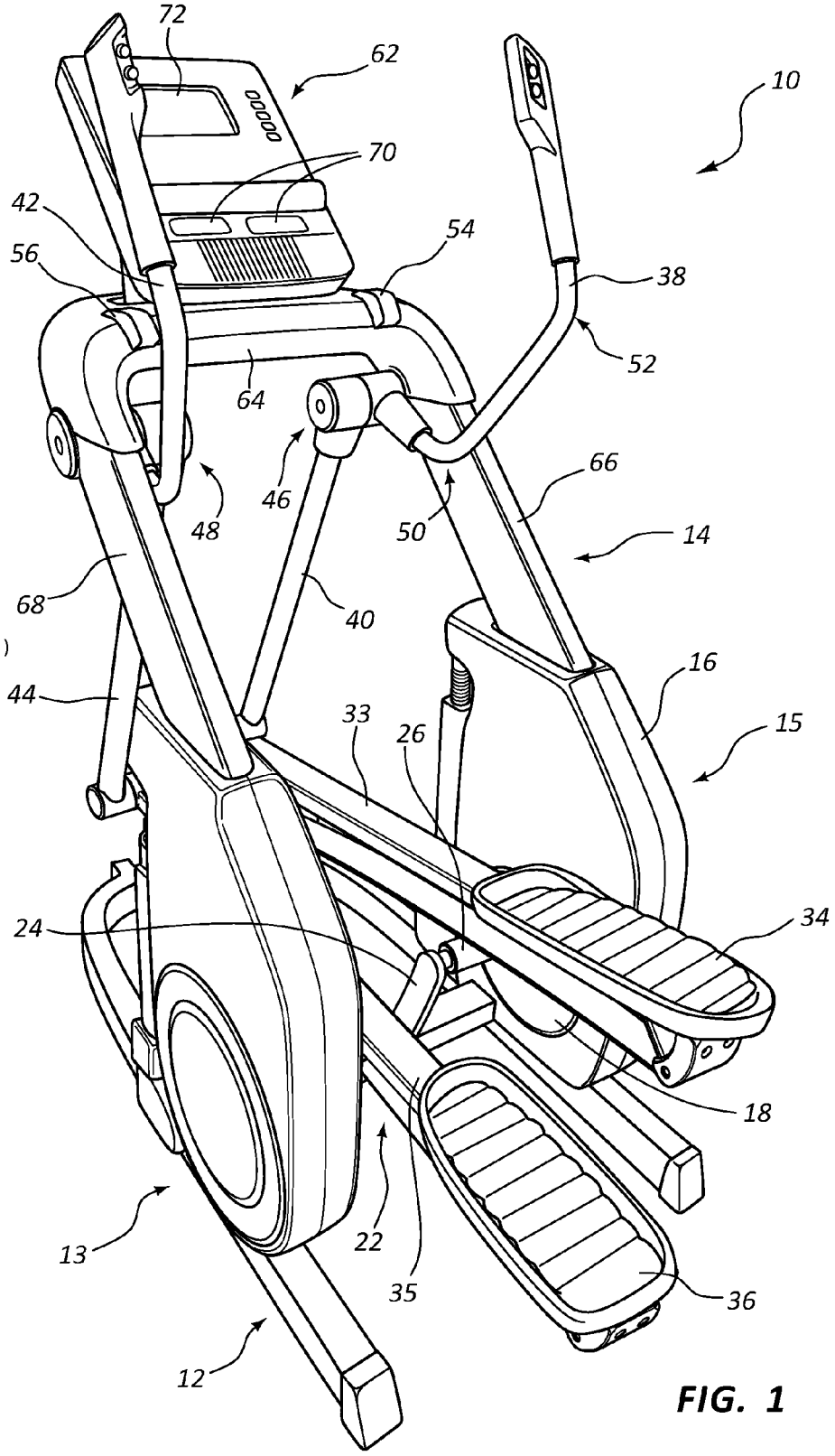
FIG. 1 illustrates a back perspective view of an example of an exercise machine in accordance with the present disclosure.

An exercise machine, such as an elliptical exercise machine, includes foot pedals that are mechanically linked together. Such foot pedals are often mechanically linked to arm supports that move with the foot pedals of the elliptical exercise machine. Thus, when any of either the foot pedals or either of the arm supports move, each of the foot pedals and each of the arm supports will also move. As a result, when a user moves any of these components, each of the components will move together.

However, linking the arm supports to the foot pedals involves engineering the arm stride to coordinate with the leg stride. Such coordination imposes limitations on the elliptical exercise machine's construction. Further, some elliptical exercise machines have the ability to do certain types of exercises that do not involve the user's arms. For example, some elliptical exercise machines have a stepper mode where the elliptical exercise machine can be used just as a stepper machine. In such examples, as the user performs a stepper workout, the arm supports move back and forth even though the user is not moving them with his or her arms. Also, as just mentioned, the movement of the user's legs causes arm supports to move, which effectively reduces the amount of energy that a user may exert to move the arm supports during a workout. Likewise, the arm movements of the user also contribute to moving the foot pedals, which can result in a lower amount of effort exerted by the user to move the foot supports.

The principles described in the present disclosure include an elliptical exercise machine where the arm supports are decoupled from the foot pedals. As a result, the effort exerted by the user to move the foot pedals does not cause the arm supports to move. Likewise, the effort exerted by the user to move the arm supports does not cause the foot pedals to move. As a result, the user can exert more energy during a workout by having to move the arm supports and the foot pedals independently. Also, in those examples where the elliptical exercise machine has different exercise modes, like a stepper exercise mode, the user can perform a workout that involves just the legs without the arm supports moving. Additionally, the engineering involved with making the elliptical exercise machine may be reduced since the movement of the foot pedals and arm supports do not have to be as coordinated when the foot pedals and the arm supports are not linked together.

A dampening assembly may be used to guide the movement of the arm supports when the user is performing a workout that involves the use of the arm supports. In some examples, the dampening assembly is an independent resistance mechanism that is dedicated to resisting the movement of the arm supports. Thus, the user's leg movement can be resisted by a pedal resistance mechanism, and the user's arm movement can be resisted by an arm resistance mechanism. The resistance mechanism for the arm supports can be of the same type of resistance mechanism as used to resist the user's leg movement. However, in other examples, the arm support's resistance mechanism can be of a different type of resistance mechanism. Such resistance mechanisms can be magnetic resistance mechanisms, pneumatic resistance mechanisms, hydraulic resistance mechanisms, gear type resistance mechanisms, braking type resistance mechanisms, tensioning type resistance mechanisms, fan blade type resistance mechanisms, other types of resistance mechanisms, or combinations thereof. Other types of dampening assemblies may include gas springs, hydraulic springs, compression springs, tension springs, coiled springs, other types of springs, other types of dampening elements, elastomeric material, or combinations thereof. Another type of dampening assembly includes a pad positioned to prevent a portion of the arm support from impacting against a portion of the elliptical exercise machine's frame by slowing the movement of the arm supports before the arm supports can contact a frame of the exercise machine.

For purposes of the present disclosure, the term "resistance mechanism" includes those components that directly interact to cause an added degree of resistance during the user's workout. For example, a resistance mechanism may include a flywheel when the exercise machine has components that can adjustably impose resistance to the movement of the flywheel, such as imposing a magnetic force on the flywheel to prevent the flywheel's rotation. The flywheel is included in the resistance mechanism when other components interact with the flywheel to directly resist the flywheel's movement. For example, braking pads, tensioning elements, fan blades, or other components can be used to directly resist the movement of the flywheel. In such examples, both the flywheel and the components interact to adjustably resist the movement of the flywheel and are included as part of the resistance mechanism.

In some examples, the exercise machine is a stationary exercise machine that does not propel the itself or otherwise change a location of the user based on the effort exerted by the user during his or her workout. Such stationary exercise machines may change the incline of the machine or otherwise change the location of the machine based on motors, drivers, actuators, hydraulic systems, or other mechanism that operate independent of the user's workout performance. For example, such functions may be operable by commands given by the user, such as selecting an option through a control module of the exercise machine.

Figure 2:
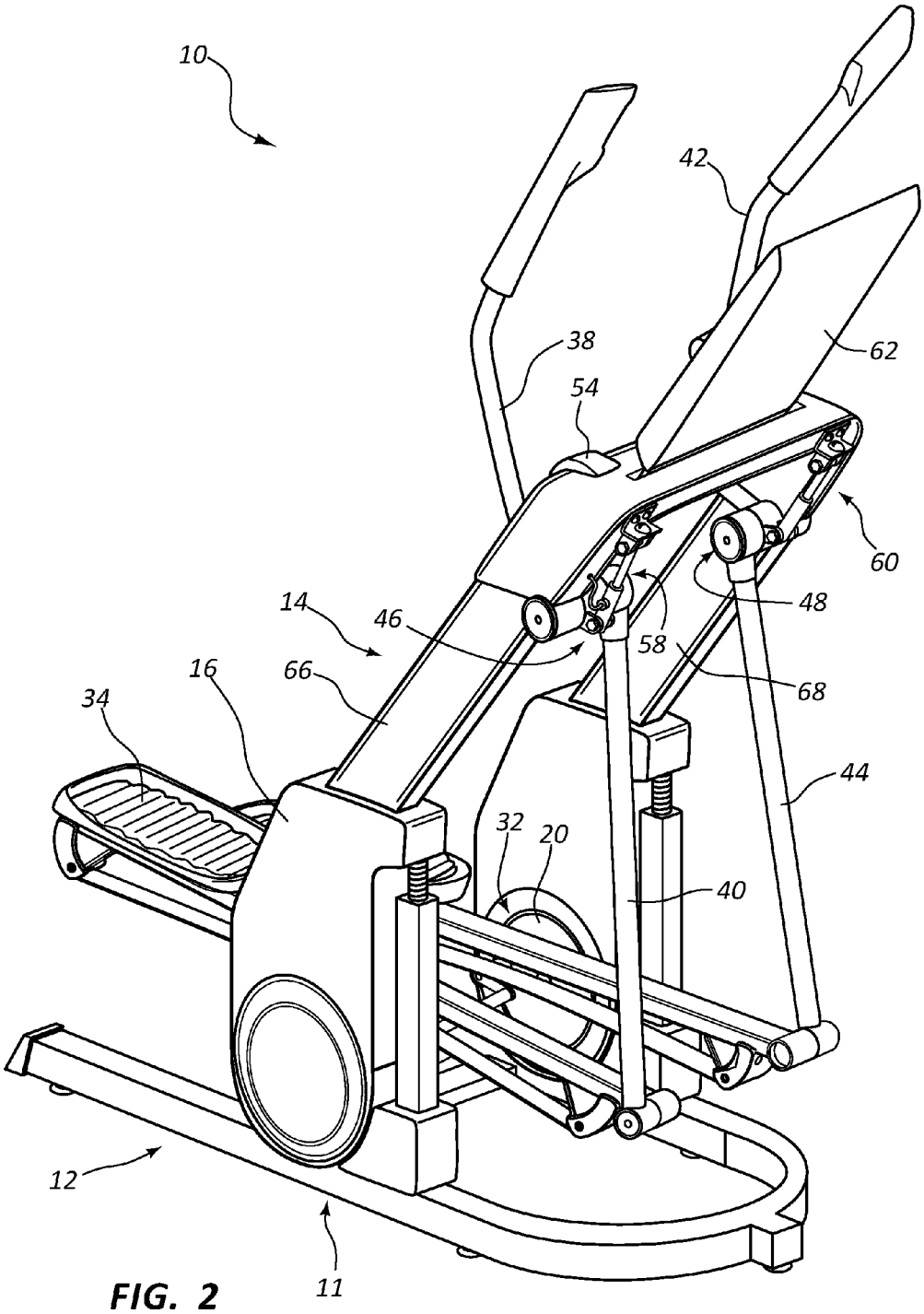
FIG. 2 illustrates a front perspective view of the exercise machine of FIG. 1.
Figure 3:
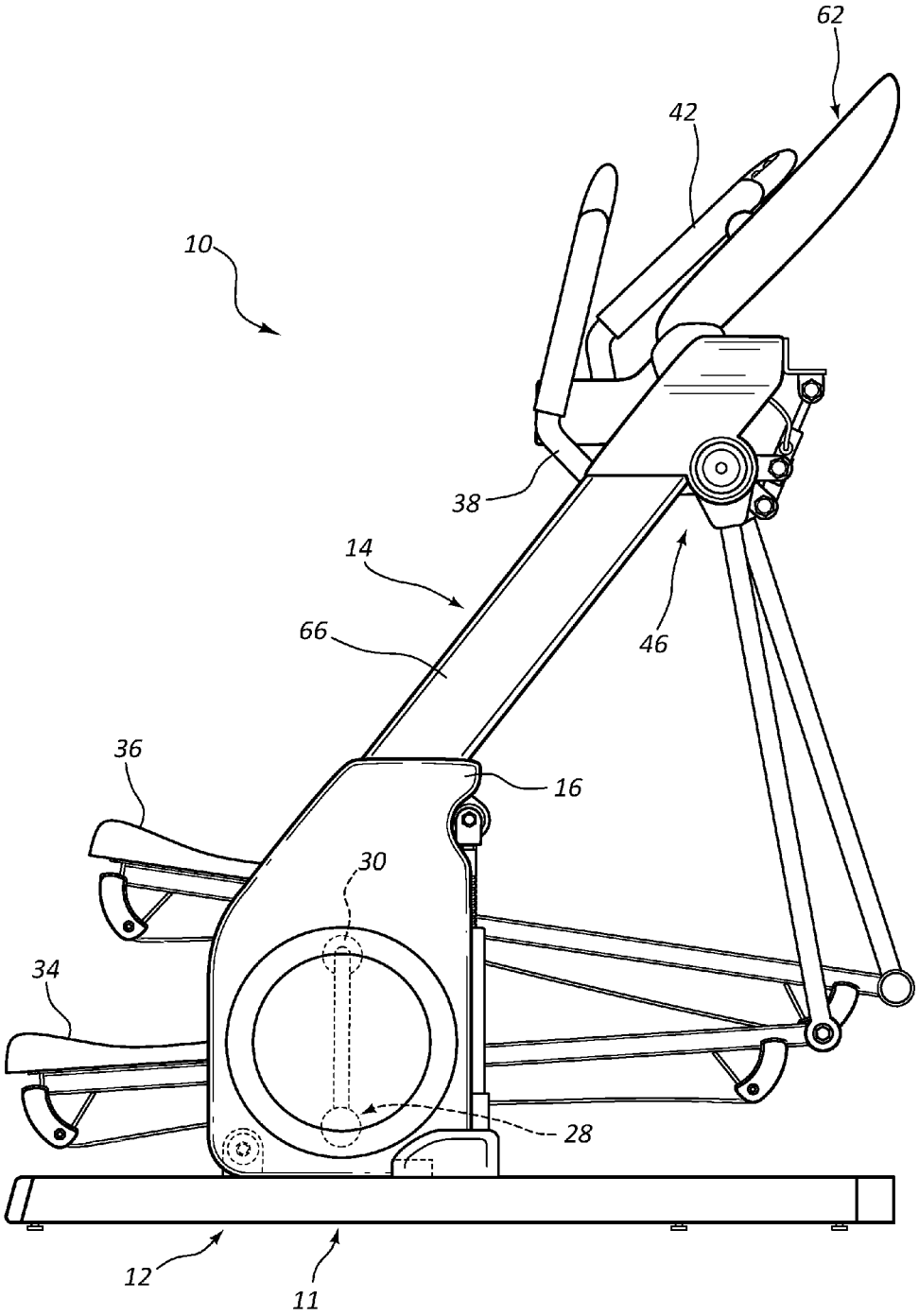
FIG. 3 illustrates a side view of the exercise machine of FIG. 1.

Particularly, with reference to the figures, FIGS. 1-3 depict an example of an exercise machine 10, such as an elliptical exercise machine. The exercise machine 10 includes a base 12 that is attached to a frame 14 at a first frame pivot connection 11 and a second frame pivot connection 13. A lower portion 15 of the frame 14 includes a housing 16 that supports a first flywheel 18 and a second flywheel 20. The first flywheel 18 and the second flywheel 20 are attached to one another through a crank assembly 22. The crank assembly 22 includes a crank arm 24 that is attached to a first shaft 26 that is connected to the first flywheel 18 on a first end 28 and attached to a second shaft 30 that is connected to the second flywheel 20 at a second end 32.

The first shaft 26 is attached to an underside of a first track 33 that supports a first foot pedal 34, and the second shaft 30 is attached to an underside of a second track 35 that supports a second foot pedal 36. The crank assembly 22 is shaped such that the first shaft 26 and the second shaft 30 follow reciprocating paths. Consequently, the first foot pedal 34 follows the path of the first shaft 26, and the second foot pedal 36 follows the path of the second shaft 30. As a user moves on the first foot pedal 34 and the second foot pedal 36 for a workout, the user's feet will also follow the reciprocating paths of the first foot pedal 34 and the second foot pedal 36. In some examples, the first foot pedal 34 is configured to slide along the length of the first track 33. Likewise, the second foot pedal 36 is configured to slide along the length of the second track 35. Thus, in some examples, the first foot pedal 34 and the second foot pedal 36 are configured to move in multiple directions: down the length of the tracks 33, 35 and with the reciprocating paths traveled by the first shaft 26 and the second shaft 30.

In the example of FIG. 1, the exercise machine 10 has multiple exercise modes. A track mode involves locking the first and second flywheels 18, 20 and allowing the foot pedals 34, 36 to slide along the tracks in a reciprocating motion. Such a mode allows a user to mimic cross country skiing motions with his legs. A stepper mode includes locking the foot pedals 34, 36 so that they are locked in a fixed position with respect to the tracks 33, 35 and allowing the foot pedals 34, 36 to move along reciprocating paths defined by the motion of the first and second flywheels 18, 20. In a combined mode, the foot pedals 34, 36 are free to move along the length of the tracks 33, 35 and along the paths defined by the first and second flywheels 18, 20 simultaneously.

The first foot pedal 34 is connected to the frame 14 through a first mechanical linkage 40, and the second foot pedal 36 is connected to the frame 14 through a second mechanical linkage 44. A first arm support 38 is connected to the frame 14 at a first combined pivot connection 46, and the second arm support 42 is connected to the frame 14 at a second combined pivot connection 48.

The first arm support 38 is not mechanically linked to the first mechanical linkage 40. Neither is the second arm support 42 mechanically linked to the second mechanical linkage 44. Thus, the movement of the first arm support 38 is independent of the movement of the first foot pedal 34.

Likewise, the movement of the second arm support 42 is independent of the second foot pedal 36. However, the first arm support 38 and the first mechanical linkage 40 are connected to the frame 14 at a shared first combined pivot connection 46. Likewise, the second arm support 42 and the second mechanical linkage 44 are connected to the frame 14 at a shared second combined pivot connection 48.

A first pivot shaft (not shown) may protrude from the first post 66 of the frame 14. The first pivot shaft may include a bearing surface and/or coating that allows for easy movement around the first pivot shaft's surface. Both the first arm support 38 and the first mechanical linkage 40 may have ends with openings shaped to slide around the first pivot shaft, which is long enough to accommodate the openings of both the first arm support 38 and the first mechanical linkage 40 simultaneously. Both the first arm support 38 and the first mechanical linkage 40 can pivot independently around the first pivot shaft. While this description has been described with respect to the first combined pivot connection 46, the second combined pivot connection 48 may be set up the same way.

The connection between the first and second arm supports 38, 42 and their respective pivot shafts may allow for free rotation of the arm supports 38, 42. However, in the illustrated example, a portion of the frame 14 blocks some of the movement of the first and second arm supports 38, 42. The first and second arm supports 38, 42 may be shaped so that the user can have a comfortable arm stride while performing a workout involving the arm supports 38, 42 without causing a portion of the arm supports 38, 42 to move into the frame 14. Such a shape may include multiple bends in the first and second arm supports 38, 42 to accommodate such an arm stride.

Dampening assemblies may be incorporated into the exercise machine 10 to guide the movement of the first and second arm supports 38, 42. For example, in some instances, the first and second arm supports 38, 42 may be inadvertently pushed into the frame 14. For such cases, a first dampening element having a first pad 54 may be secured to the frame 14 to soften an impact between the first arm support 38 and the frame 14 by slowing the movement of the first arm support 38 as it approaches the frame 14. Likewise, a second dampening element having a second pad 56 may be secured to the frame 14 to soften an impact between the second arm support 42 and the frame 14.

The pads 54, 56 may be made of any appropriate type of material. For example, the pads 54, 56 may be made of rubber, an elastomeric material, a closed cell foam, an open cell foam, a spring like material, a compressible material, another type material, or combinations thereof. In some examples, multiple layers of appropriate materials are combined to provide a pad with desirable properties for reducing or eliminating an impact between the first and second arm supports 38, 42 and their corresponding sections of the frame 14.

In addition to or in lieu of the first and second pads 54, 56, another type of dampening element may be incorporated into the exercise machine 10 to guide the first and second arm supports' movements. For example, a first gas spring 58 and a second gas spring 60 may be used to resist impacts between the first and second arm supports 38, 42 and their corresponding sections of the frame 14. Further, such first and second gas springs 58, 60 may be used to provide additional resistance to the movement of the first and second arm supports 38, 42.

The dampening elements of the dampening assembly may restrict some of the range of the movement of the arm supports. In some examples, the frame 14 may not be positioned in the path of the arm supports 38, 42. However, in such examples, the dampening elements may still restrict the arm support's movement. While the examples herein have been described with reference to specific types of dampening assemblies, any appropriate type of dampening assembly may be used in accordance with the principles described herein. For example, any appropriate type of feature incorporated into the exercise machine that can slow the movement of the arm supports along any appropriate location of the arm's travel may be used in accordance with the principles described herein. For example, the dampening element/dampening assembly may include gas springs, pads, compression springs, tension springs, metal springs, elastomeric material, mechanism to increase the friction between the exercise machine's frame and the arms, other types of features, or combinations thereof.

In some examples, a locking mechanism is built into the exercise machine 10 to prevent the movement of the first and second arm supports 38, 42. The locking mechanism can be utilized in situations where the exercise machine 10 is used for an activity that does not involve the arm supports 38, 42, such as when the exercise machine 10 is in a stepper mode. Any appropriate type of locking mechanism may be used. For example, a retractable pin may be temporarily inserted into an opening of one of the arm supports 38, 42. In other examples, the locking mechanism includes solenoids, magnets, bars, clips, ropes, flaps, loops, other types of locking mechanisms, or combinations thereof.

In the example of FIG. 1, a control module 62 is connected to a cross bar 64 that connects the first post 66 of the frame 14 to a second post 68 of the frame 14. The control module 62 may include multiple buttons 70, a display 72, a cooling vent, a speaker, another device, or combinations thereof. The control module 62 can include a resistance input mechanism that allows the user to control how much resistance is applied to the movement of the first and second foot pedals 34, 36. In some examples, the control module 62 also includes another resistance input mechanism that controls a level of resistance for movement of the arm supports 38, 42. The control module 62 may also provide the user with an ability to control other functions of the exercise machine 10. For example, the control module 62 may be used to control a level of a climate control, to control an incline angle between the frame 14 and the base 12, to control speaker volume, to select a pre-programmed workout, to control entertainment through the speakers of the display 72 of the control module 62, to monitor a health parameter of the user during a workout, to communicate with a remote trainer or computer, to control other functions, or combinations thereof.

Figure 4:
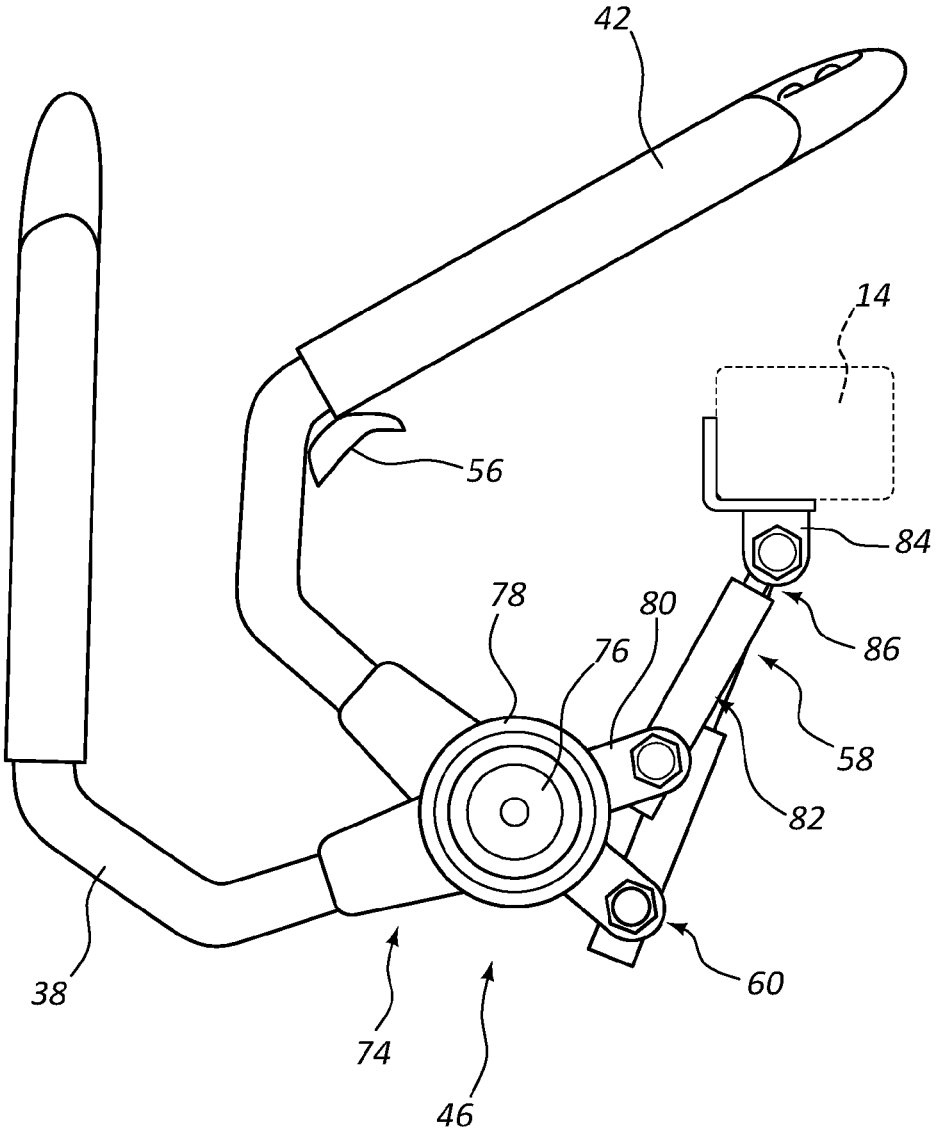
FIG. 4 illustrates a close up side view of the exercise machine of FIG. 1 with portions of the frame removed for illustrative purposes.

FIG. 4 illustrates a close up side view of the exercise machine of FIG. 1 with portions of the frame 14 removed for illustrative purposes. In this example, an end 74 of the first arm support 38 is pivotally connected to a first pivot shaft 76 of the first combined pivot connection 46. The end 74 forms a ring 78 with an opening that fits around the first pivot shaft 76. Opposite to the end 74 of the first arm support 38, a first tab 80 protrudes out of the ring 78 and connects to a first end 82 of the first gas spring 58. A second tab 84 protrudes from the frame 14 and connects to a second end 86 of the first gas spring 58.

The first and second ends 82, 86 of the first gas springs 58 collectively form an internal chamber that contains a compressible gas. The second end 86 is inserted into the chamber with seals to prevent the gas from leaking out of the internal chamber. The second end 86 also includes a flange (not shown) that separates the internal chamber into first and second sub-chambers. As the first arm support 38 rotates about the first pivot shaft 76, the first tab 80 moves the first end 82 of the first gas spring 58 linearly with respect to the second end 86 of the first gas spring 58. As a result, the first gas spring 85 telescopingly extends and contracts. When the first gas spring 58 contracts, the compressible gas of a first sub-chamber compresses and resists the contraction of the first gas spring 58, and therefore the movement of the first arm support 38 in a first direction. Likewise, when the first gas spring 58 extends, gas in a second sub-chamber of the first gas spring 58 compresses, which also resists the movement of the first arm support 38 in a second direction.

While this example has been described with reference to a specific type of gas spring, any appropriate type of gas spring may be used in accordance with the principles described in the present disclosure. For example, the gas springs may incorporate hollow plungers, multiple diameter rods, Schrader-type values, O-rings, gas generator cells, heaters, adjustable features, other types of features, or combinations thereof. Further, the gas springs may be extendable and retractable with any appropriate stroke length.

Figure 5:
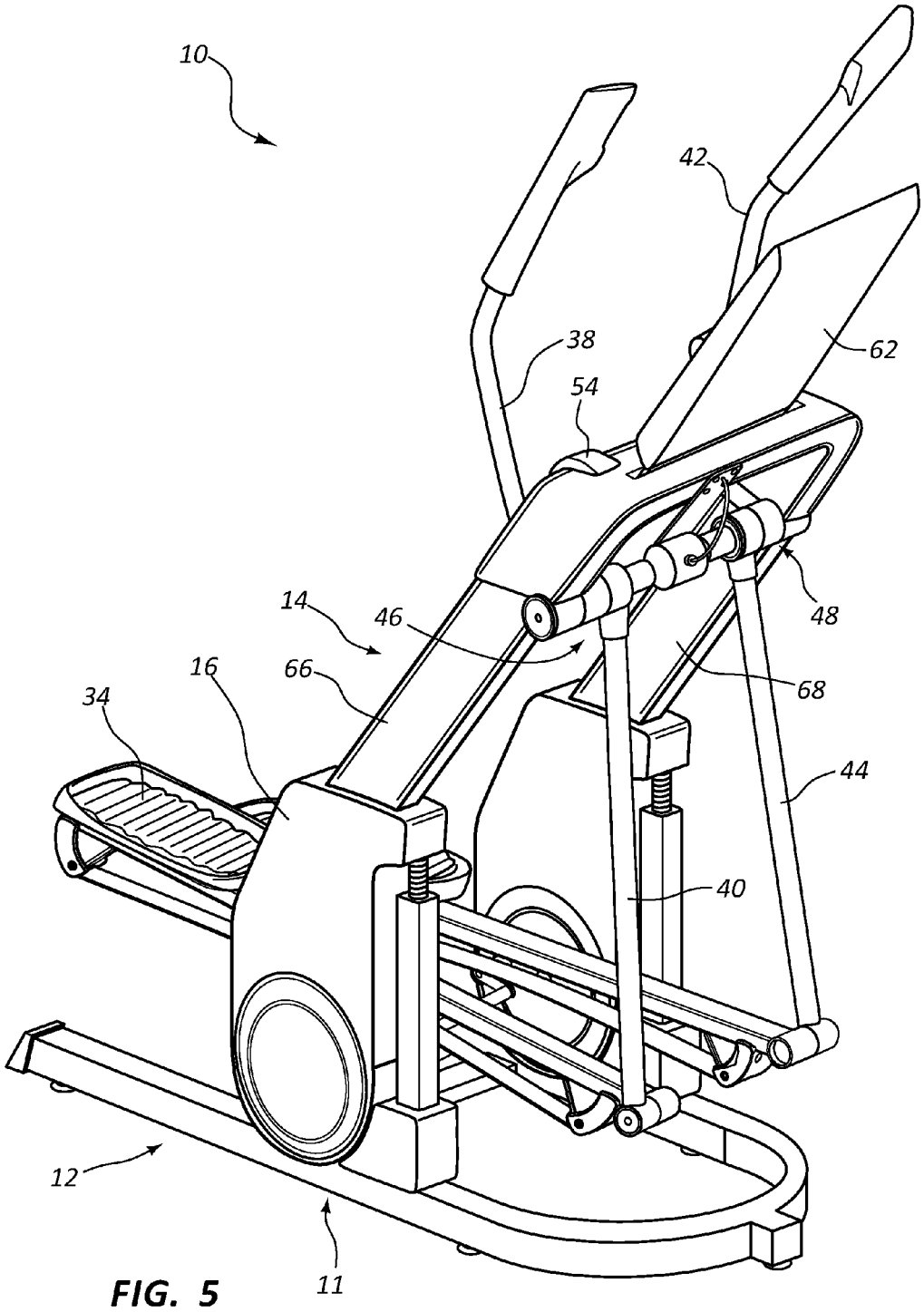
FIG. 5 illustrates a perspective view of an example of multiple resistance mechanisms incorporated into an exercise machine in accordance with the present disclosure.

FIG. 5 illustrates a perspective view of an example of multiple resistance mechanisms incorporated into an exercise machine in accordance with the present disclosure. In this example, the first and second flywheels 18, 20 are part of the pedal resistance mechanism and provide resistance to the movement of the foot pedals 34, 36 along a reciprocating path defined by the crank arm 24. In such an example, the flywheels include a magnetic resistance mechanism that resists the movement of the foot pedals 34, 36. In some cases, just one of the first or second flywheels 18, 20 provides resistance to the movement of both the first and second foot pedals 34, 36 through the crank assembly 22. Further, a sliding resistance mechanism 88 incorporating bands positioned on an underside of the tracks 33, 35 can provide resistance to movement of the foot pedals 34, 36 along the length of the tracks 33, 35. An independent, adjustable arm resistance mechanism 90 is incorporated into the exercise machine to provide an adjustable amount of resistance to the movement of the arm supports 38, 42.

The adjustable arm resistance mechanism 90 is positioned between the first combined pivot connection 46 and the second combined pivot connection 48. The rings of the first and second arm supports 38, 42 that form the openings that fit over their respective pivot shafts are in communication with the adjustable arm resistance mechanism 90. In such an example, rings of the first and second mechanical linkages 40, 44 can be fitted over a portion of the rings of the first and second arm supports 38, 42 such that the first and second mechanical linkages 40, 44 can pivot about the rings of the first and second arm support 38, 42.

The adjustable arm resistance mechanism 90 may include any appropriate type of resistance mechanism to control the amount of resistance applied to the movement of the first and second arm supports 38, 42. In some examples, a magnetic resistance mechanism is used. The adjustable arm resistance mechanism 90 may be in communication with the control module 62 so that the user can adjust the level of resistance while the user is performing a workout.

Figure 6A:
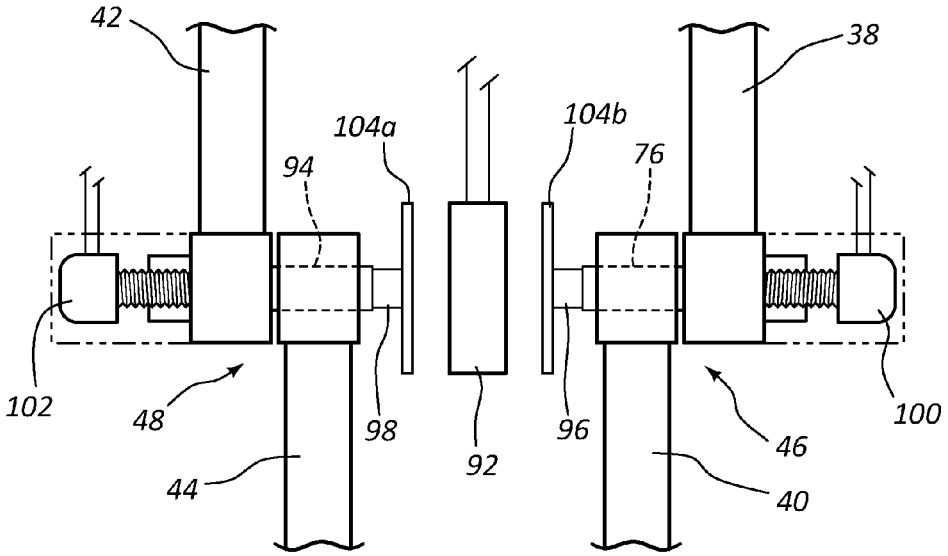
FIG. 6A illustrates a side view of an example of a resistance mechanism incorporated into an exercise machine in accordance with the present disclosure.
Figure 6B:
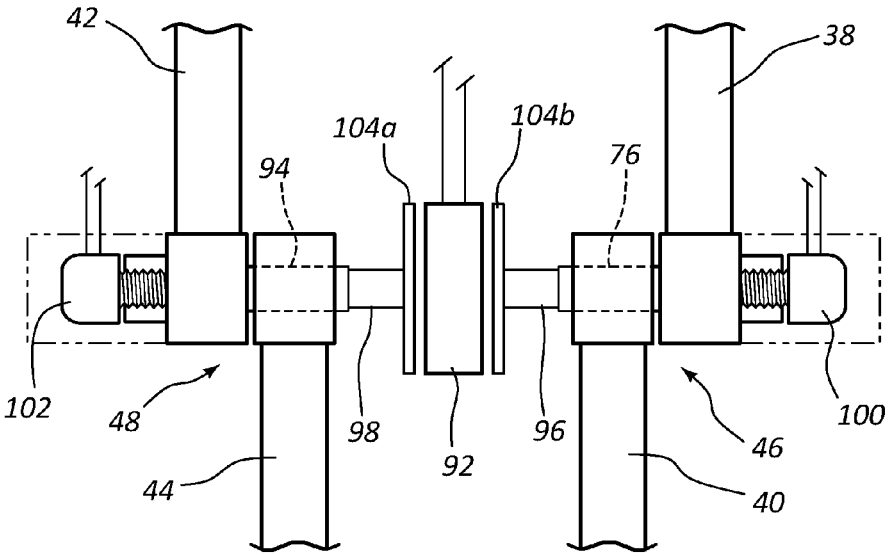
FIG. 6B illustrates a side view of an example of a resistance mechanism incorporated into an exercise machine in accordance with the present disclosure.

FIGS. 6A-6B illustrate side views of an example of an adjustable arm resistance mechanism 90 incorporated into an exercise machine 10 in accordance with the present disclosure. In this example, the adjustable arm resistance mechanism 90 includes a magnetic unit 92 positioned between the first and second combined pivot connections 46, 48. Each of the first pivot shaft 76 and the second pivot shaft 94 support their respective mechanical linkages 40, 44 and their respective arm supports 38, 42. Each of the first and second arm supports 38, 42 are rotationally locked to an first extendable piston 96 and a second extendable piston 98 respectively. The extending length of the first and second extendable pistons 96, 98 are controlled by a first screw motor 100 and a second screw motor 102 respectively. As the screw motors 100, 102 move the first and second extendable pistons 96, 98 closer to the magnetic unit 92, the magnetic forces of the magnetic unit 92 increasingly resist the rotation of a first magnetically conductive plate 104*a* and a second magnetically conductive plate 104*b* attached to the ends of the first and second extendable pistons 96, 98 respectively. Thus, to increase the resistance to the arm supports 38, 42, the plates 104*a*, 104*b* are moved closer to the magnetic unit 92. To decrease the resistance to the arm supports 38, 42, the plates 104*a*, 104*b* are moved away to the magnetic unit 92.

In some examples, the plates 104*a*, 104*b* are moved with respect to the magnetic unit 92 together, which provides a consistent amount of resistance to the movement of both the first and second arm supports 38, 42. However, in other examples, the resistance to the movement of the first arm support 38 can be different than the resistance applied to the movement of the second arm support 42. In such an example, the plates 104*a*, 104*b* can be positioned at any appropriate distance from the magnetic unit 92.

While this example has been described with specific reference to changing a resistance level by changing a distance between magnetically conductive plates 104*a*, 104*b* and the magnetic unit, any appropriate type of mechanisms can be used in the resistance mechanism. For example, the plates 104*a*, 104*b* may be moved with a hydraulic pressure, a pneumatic pressure, a gear assembly, another type of mechanism, or combinations thereof. Further, the level of resistance may be adjusted by increasing or decreasing a magnetic field output while the plates 104*a*, 104*b* remain at a fixed distance. In yet other examples, the magnetic unit 92 or a portion of the magnetic unit 92 moves to narrow a gap between the magnetic unit 92 and the plates 104*a*, 104*b*. Further, the adjustable arm resistance mechanism 90 may include another type of mechanism for applying resistance to the movement of the arm supports 38, 42 that does not involve a magnetic force.

Figure 7:
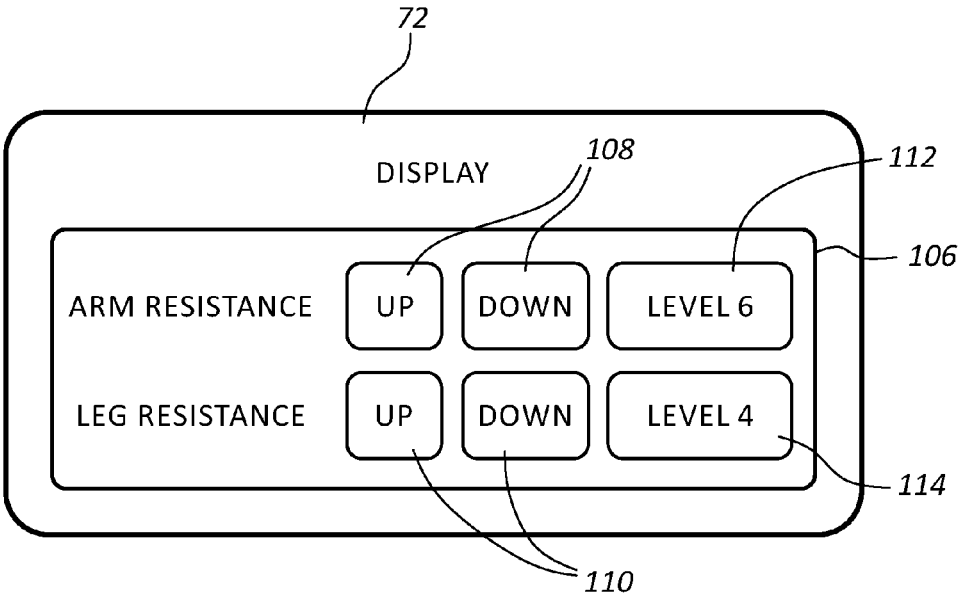
FIG. 7 illustrates a front view of an example of a display of an exercise machine in accordance with the present disclosure.

FIG. 7 illustrates a front view of an example of a display 72 of an exercise machine 10 in accordance with the present disclosure. In this example, the display 72 includes a touch screen 106 with a first set 108 of buttons to adjust the level of resistance for the movement of the arm supports 38, 42. Likewise, the touch screen 106 includes a second set 110 of buttons to adjust the level of resistance for the movement of the foot pedals 34, 36. Further, the touch screen 106 also includes an arm level indicator 112 that indicates the resistance level applied to the first and second arm supports 38, 42. Likewise, the touch screen 106 further includes an independent foot pedal level indicator 114 that indicates the resistance level applied to the first and second foot pedals 34, 36. In this example, the user has set the arm resistance level to be at a different level than the leg resistance level.

Figure 8:
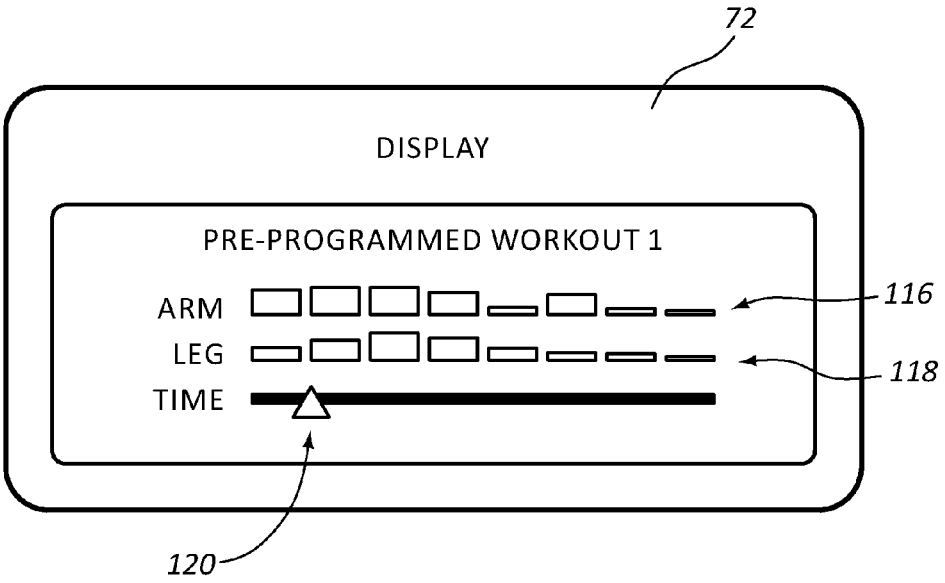
FIG. 8 illustrates a front view of an example of a display of an exercise machine in accordance with the present disclosure.

FIG. 8 illustrates a front view of an example of a display 72 of an exercise machine 10 in accordance with the present disclosure. In this example, the display 72 depicts a pre-programmed workout. An arm resistance bar graph 116 indicates how the pre-programmed workout will modify the resistance to the movement of the arm supports 38, 42 over the course of the pre-programmed workout. Likewise, leg resistance bar graph 118 indicates how the pre-programmed workout will modify the resistance to the movement of the foot pedals 34 36 over the course of the pre-programmed workout. In this example, the resistance is to be applied to the arm supports 38, 42 and the foot pedals 34, 36 are different over the course of the pre-programmed workout. However, in other examples, the resistance levels to be applied to the arm supports 38, 42 and the foot pedals 34, 36 are the same over the course of the pre-programmed workout. A time indicator 120 indicates the current time duration of the pre-programmed workout, which also indicates the upcoming resistance changes.

INDUSTRIAL APPLICABILITY

In general, the invention disclosed herein may provide a user an ability to increase the amount of exertion during a workout because the effort exerted to move the foot pedals does not contribute to the movement of the arm supports and vice versa. Thus, the user can burn more calories during the same workout time period. Additionally, the user can target different muscle groups during a workout. For example, the user may desire to increase the resistance to move the arm supports to target arm muscles while keeping the resistance lower for moving the foot pedals or vice versa.

The exercise machines disclosed herein also provide the user an ability to workout in a stepping mode or another type of mode without having the arm supports move. These advantages give the user an ability to customize his or her workout without having the distraction of the arm supports moving.

The dampening elements provide a significant benefit for resisting the movement of the arm supports. For example, a pad can reduce inadvertent impacts between the frame and the arm supports. Likewise, gas springs can add resistance to the movement of the arm supports. Such resistance may also prevent inadvertent impacts between the arm supports and the frame by slowing the movement of the first and second arm supports. In some examples, the resistance to the movement of the arm supports may be intensified as the arm support approaches the frame. Such an increased resistance may be accomplished with a gas spring that produces an increased amount of resistance as the gas spring approaches a maximum extension. Also, an adjustable arm resistance mechanism can also mitigate or eliminate inadvertent impacts.

What is claimed is:

1. An exercise machine, comprising:

a first foot pedal and a second foot pedal movably attached to a frame and arranged to travel along reciprocating paths;

a pedal resistance mechanism integrated into the exercise machine and arranged to resist the travel along the reciprocating paths of the first foot pedal and the second foot pedal along the reciprocating paths;

a first arm support and a second arm support movably attached to the frame where the first arm support and the second arm support are mechanically independent of the first foot pedal and the second foot pedal; and a dampening assembly arranged to resist movement of the first arm support and the second arm support;

wherein the dampening assembly includes an adjustable arm resistance mechanism, the adjustable arm resistance mechanism including:

a magnetic unit; and at least one extendable piston connected to at least one of the first arm support and the second arm support adjacent to the magnetic unit;

wherein the extendable piston is configured to selectively move relative to the magnetic unit to modify the resistance to movement by the at least one of the first arm support and second arm support.

2. The exercise machine of claim 1, wherein the dampening assembly further comprises a pad positioned to slow the movement of the first arm support and/or the second arm support.

3. The exercise machine of claim 1, wherein the dampening assembly further comprises a gas spring with a first end connected to the frame and a second end connected to either of the first arm support or the second arm support.

4. The exercise machine of claim 1, wherein the dampening assembly comprises a first dampening unit proximate the first arm support and a second dampening unit proximate the second arm support.

5. The exercise machine of claim 1, wherein the adjustable arm resistance mechanism is arranged to change a resistance level in response to user input from an input mechanism incorporated into a control module of the exercise machine.

6. The exercise machine of claim 1, wherein the exercise machine is an elliptical exercise machine.

7. The exercise machine of claim 1, wherein the pedal resistance mechanism is a magnetic resistance that comprises at least one flywheel.

8. The exercise machine of claim 1, wherein the first foot pedal is connected to the second foot pedal through a crank assembly.

9. The exercise machine of claim 8, wherein the crank assembly comprises a first shaft connected to the first foot pedal and a first flywheel and a second shaft connected to the second foot pedal and a second flywheel.

10. The exercise machine of claim 1, wherein the dampening assembly restricts a range of the movement of the first arm support and the second arm support.

11. An exercise machine, comprising:

a first foot pedal and a second foot pedal movably attached to a frame and arranged to travel along reciprocating paths;

a pedal resistance mechanism integrated into the exercise machine and arranged to resist the travel along the reciprocating paths of the first foot pedal and the second foot pedal along the reciprocating paths;

the first foot pedal is connected to the second foot pedal through a crank assembly;

the crank assembly comprises a first shaft connected to the first foot pedal and a first flywheel and a second shaft connected to the second foot pedal and a second flywheel;

a first arm support and a second arm support movably attached to the frame where the first arm support and the second arm support are mechanically independent of the first foot pedal and the second foot pedal;

a dampening assembly arranged to resist a movement of the first arm support and the second arm support; and the dampening assembly comprises a first dampening unit approximate the first arm support and a second dampening unit proximate the second arm support;

wherein the dampening assembly includes an adjustable arm resistance mechanism, the adjustable arm resistance mechanism including:

a magnetic unit;

at least one extendable piston connected to at least one of the first arm support and the second arm support;

wherein the extendable piston is configured to move relative to the magnetic unit to modify the resistance to movement by the at least one of the first arm support and second arm support.

12. The exercise machine of claim 11, wherein the dampening assembly further comprises a pad positioned to slow the movement of either the first arm support or the second arm support.

13. The exercise machine of claim 11, wherein the dampening assembly further comprises a gas spring with a first end connected to the frame and a second end connected to either of the first arm support or the second arm support.

14. The exercise machine of claim 11, wherein the dampening assembly includes an adjustable arm resistance mechanism.

15. An exercise machine, comprising:

a first foot pedal and a second foot pedal movably attached to a frame and arranged to travel along reciprocating paths;

a pedal resistance mechanism integrated into the exercise machine and arranged to resist the travel along the reciprocating paths of the first foot pedal and the second foot pedal along the reciprocating paths;

the first foot pedal is connected to the second foot pedal through a crank assembly;

the crank assembly comprises a first shaft connected to the first foot pedal and a first flywheel and a second shaft connected to the second foot pedal and a second flywheel;

a first sliding resistance mechanism incorporated into the first track and a second sliding resistance mechanism incorporated into the second track;

a first arm support and a second arm support movably attached to the frame where the first arm support and the second arm support are mechanically independent of the first foot pedal and the second foot pedal;

a dampening assembly arranged to resist movement of the first arm support and the second arm support; and the dampening assembly comprises a first dampening unit approximate the first arm support and a second dampening unit proximate the second arm support;

the dampening assembly includes an adjustable arm resistance mechanism, the adjustable arm resistance mechanism including:

a magnetic unit;

at least one extendable piston connected to at least one of the first arm support and the second arm support;

wherein the extendable piston is configured to move relative to the magnetic unit to modify the resistance to movement by the at least one of the first arm support and second arm support.

* * * * *